United States Patent [19]

Voorhees

[11] 4,445,240

[45] May 1, 1984

[54] LIQUID FILLED COMPARTMENTED CUSHION

[75] Inventor: John Voorhees, Wichita, Kans.

[73] Assignee: Ideal Comfort, Inc., Wichita, Kans.

[21] Appl. No.: 931,842

[22] Filed: Aug. 7, 1978

[51] Int. Cl.[3] ..... A47C 27/10

[52] U.S. Cl. ..... 5/451; 5/441; 5/455

[58] Field of Search ..... 297/DIG. 3; 5/451, 452, 5/449, 455, 441

[56] References Cited

U.S. PATENT DOCUMENTS

| | | | |
|---|---|---|---|
| 1,306,787 | 6/1919 | Stevenson | 5/365 |
| 2,199,047 | 4/1940 | Fisher | 5/368 |
| 2,582,439 | 1/1952 | Kavanagh | 297/DIG. 3 |
| 3,648,308 | 3/1972 | Greenwalt | 297/391 |
| 3,848,282 | 11/1974 | Viesturs | 5/451 |
| 3,965,508 | 6/1976 | Hunter | 5/451 |
| 4,115,934 | 9/1978 | Hall | 36/29 |
| 4,121,310 | 10/1978 | Gorran | 5/370 |
| 4,167,795 | 9/1979 | Lambert, Jr. | 5/451 |

FOREIGN PATENT DOCUMENTS

| | | | |
|---|---|---|---|
| 411830 | 4/1925 | Fed. Rep. of Germany | 5/448 |
| 1202100 | 1/1960 | France | 5/368 |
| 978348 | 12/1964 | United Kingdom | 5/368 |

*Primary Examiner*—Alexander Grosz
*Attorney, Agent, or Firm*—Robert R. Keegan

[57] ABSTRACT

There is disclosed a cushion of flexible plastic sheet material adapted to be filled with water or other liquid wherein the interior space is divided into at least two compartments, one of which is annular, the shape being particularly adapted to provide a cushion with firm, comfortable support while at the same time being simple and inexpensive to manufacture. Separate filler openings are provided for the two compartments which permits their being filled independently, to different degrees if desired. The cushion is preferably provided with a textile fabric cover which is removable for storage and shipping.

15 Claims, 5 Drawing Figures

LIQUID FILLED COMPARTMENTED CUSHION

Inflatable cushions, mattresses, etc., are of course well known. It is also known to provide compartments or partitions in inflatable cushions and mattresses. When partitions or compartments are provided it is common to provide openings so that the inflating fluid can be introduced from a single filling opening.

Notwithstanding the numerous types of inflatable cushions which have been devised, they have not achieved wide usage in comparison with cushions of foam material, for example. The present invention provides a cushion which is particularly adapted to be filled with water or other liquid rather than being inflated with air or some other gas. The cushion is preferably somewhat larger than is customary for portable foam cushions, being approximately 18 inches across. The cushion according to the invention is compartmented with one annular compartment and one central compartment. These compartments are completely isolated and provided with separate filling valves. The liquid, therefore, cannot transfer from one compartment to another, and the filling of the two compartments may be made to the same level or two different levels as desired. Preferably, the cushion according to the invention is provided with a cover made of a textile fabric such as woven or knit cotton, synthetic, or blended material. The cover may conveniently be sewn to form a complete enclosure for the plastic water filled cushion with an opening between overlapping edges running down the middle of one side of the cover in order that the cushion may easily be inserted into and removed from the cover.

The cushion according to the present invention provides a portable cushion which is very comfortable in difficult situations such as long periods of sitting without opportunity for movement or stretching and for persons with obesity problems, back problems, or other problems tending to produce sitting discomfort.

In addition to providing the above features and advantages, it is an object of the present invention to provide a liquid filled cushion having separate compartments, at least two in number, shaped to provide an exceptional degree of comfort as a seat cushion.

It is another object of the present invention to provide a liquid filled cushion with a plurality of entirely separate compartments with separate filling valves so that the compartments may be filled in the same or different degree as may be desired.

It is still another object of the present invention to provide a water filled seat cushion having an annular compartment measuring about 18 inches across in which the opening in the center of the annulus is about half the dimension across said cushion.

Other objects and advantages of the present invention will be apparent from consideration of the following description in conjunction with the appended drawings in which.

Figure 1:
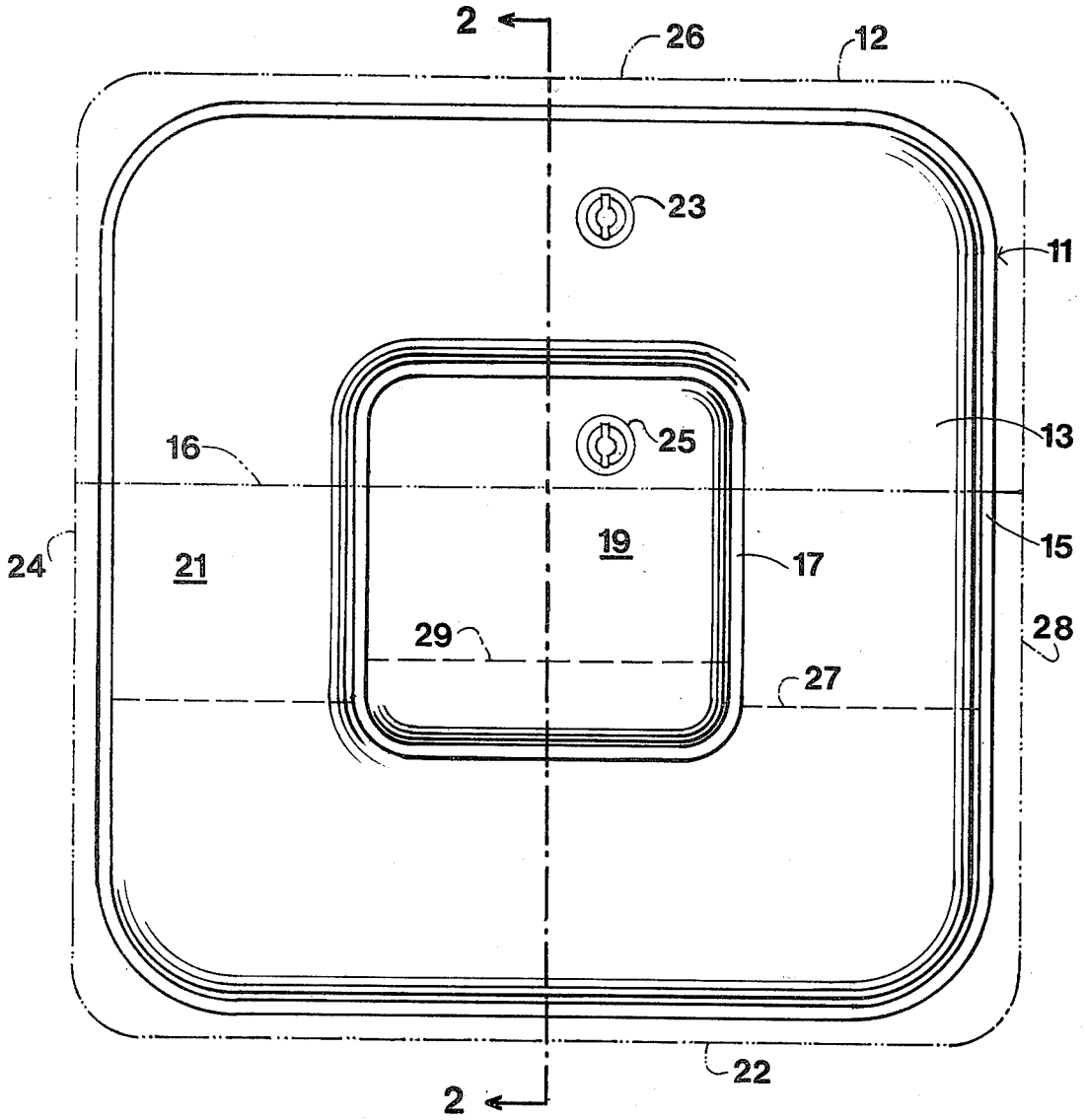
FIG. 1 is a top plan view of one embodiment of a cushion according to the invention.

Referring to the drawings and particularly FIG. 1, there is shown a cushion 11 having a cover 12. In order to better show the form of cushion 11, the cover 12 is indicated only in phantom lines in FIG. 1. The cushion 11 is fabricated from two sheets of flexible plastic such as PVC vinyl sheeting of approximately 0.015 inches thickness and 1.2 specificity gravity. A top sheet of plastic 13 is joined to a bottom sheet 14 (see FIG. 2) preferably by heat sealing along a peripheral seam 15.

Another seam 17 formed by heat sealing divides the enclosed space between sheets 13 and 14 into two isolated compartments. The central compartment is indicated at 19 and the annular compartment is indicated at 21. By way of example, the central compartment 19 may be generally square and have a tranvserve dimension of seven inches approximately, while the transverse dimension of the entire cushion may be approximately 16 inches. The heat sealed seams 15 and 17 may be approximately ¼ inch in width. As previously mentioned, the plastic sheet material for the top sheet 13 and the bottom sheet 14 is preferably approximately 0.015 inches thick. This thickness could readily vary from 0.01 to 0.03 inches, however. It is desired that the sheet have a high degree of flexibility but that it have a relatively low degree of stretchability or extensibility. For example, it may have an elongation property of M.D. 300; T.D. 350, and a tensile property in pounds per square inch of M.D. 2400; T.D. 2200 (ASTM D-882). The plastic material should also be highly hesitant to puncture or tearing. The sheet material of PVC vinyl may, for example, be of the properties of such material sold under the trademark "Aquaflex" by Pantasote Co. of New York, Inc. Individual filler ports 23 and 25 are provided for compartments 21 and 19 respectively. The filler ports may be of any suitable form permitting access to the compartments 19 and 21 for filling them with liquid and incorporating a secure closure to retain the liquid in the compartments 19 and 21 without leakage. An example of a suitable filler port with closure is illustrated in detail in FIG. 3.

Filler port 23 consists of a tube portion 31 having a flange 32. The flange 32 permits the filler port 23 to be heat sealed over an opening in the plastic sheet material forming the cushion 11. Filler port 23 is provided with a cap 33 which is customarily attached to the tube 31 by a flexible band 34 thereby avoiding displacement and loss of the cap 33.

Figure 3:
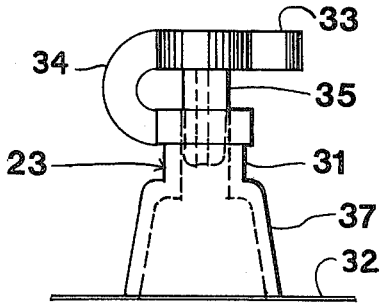
FIG. 3 is an enlarged detail view of a filler port which may be employed in the cushion of FIGS. 1 and 2.

The cap 33 is provided with a tapered plug 35 fitting inside tube 31, the enlarged portion 37 of which turns inside out for partial retraction of filler port 23. The filler port shown in FIG. 3 is given by way of illustration and any other filler port used in inflatable toys or the like may be employed.

Figure 2:
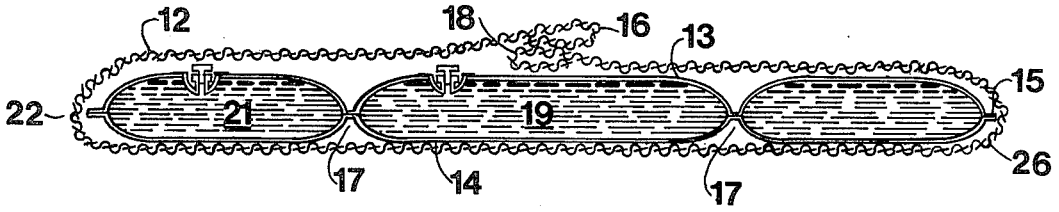
FIG. 2 is a sectional view taken along the line 2—2 in FIG. 1.

The cover 12 is preferably formed of a textile fabric rather than plastic and may be conveniently fabricated by machine stitching from a single piece of textile fabric. Referring particularly to FIG. 2, a piece of textile fabric forming the cover 12 may extend from one end 16 located near the center of the cushion, around the end and across the bottom around the other end and back to the center of the top of the cushion at 18. Ends 16 and 18 are preferably folded over to form a hem and are arranged to overlap slightly so that the cushion 11 is completely enclosed within the cover 12. Thus, the single piece of textile fabric extends as shown in FIG. 2 from one end 16 around the cushion edge at 22, across the bottom of the cushion, back around a second cushion edge at 26, and to the top center of the cushion at 18. Referring to FIG. 1, the edges of the cover, 24 and 28, would be closed by machine stitching in conventional fashion. In accordance with usual practice, the cover 12 would be turned inside out after machine stitching in order that the fabric edges at the seams would be on the inside of the cover.

Figure 4:
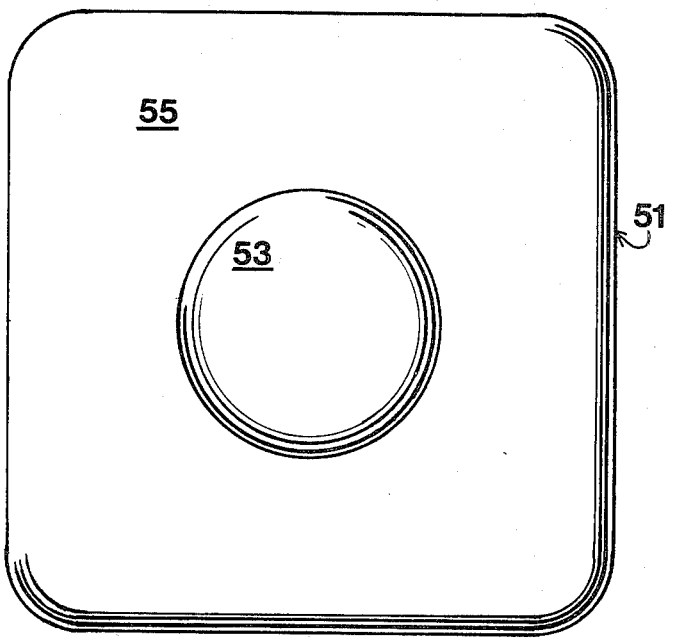
FIG. 4 is a top plan view of an alternative embodiment of the invention.
Figure 5:
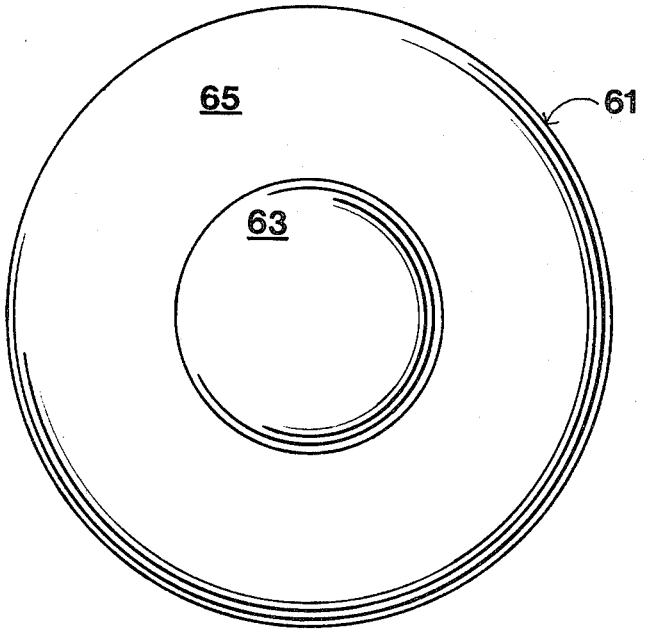
FIG. 5 is a top plan view of a second alternative embodiment of the invention.

The particular form of cushion shown in FIG. 1 in which both the central compartment 19 and the annular compartment 21 are generally square in shape is a practical and useful one. However, other shapes for the cushion may also be utilized as illustrated in FIGS. 4 and 5. FIG. 4 illustrates a cushion 51 with an overall square shape but wherein the interior or central compartment 53 is generally circular. The annular compartment 55 therefore has an outer rectangular shape with a generally circular opening in the center.

FIG. 5 shows a cushion 61 wherein both the central compartment 63 and the outer annular compartment 65 are generally circular in shape.

A significant advantage of the cushion according to the invention is the fact that it can be shipped and sold without its liquid contents, in which condition it is very light and compact. The unfilled cushion typically weighs less than half a pound and the cover for the cushion less than one quarter of a pound.

The cushion will customarily be sold unfilled except possibly when it is sold at a point of use such as a sports arena. Appropriate instructions are to be provided for filling the cushion. First of all, the cushion is intended to be filled with liquid rather than air. Liquid is preferred because it has a high density and it is substantially incompressible. Normally the cushion would be filled with ordinary tap water. In special circumstances where the cushion might be intermittently exposed to storage at freezing temperatures, an anti-freeze solution might be used in the cushion. Preferably, the liquid in the cushion should be near body temperature or about 95° F. In cold weather it may be desirable to make the temperature somewhat higher, and in warm weather it may be desirable to make the temperature somewhat lower.

The cushion is preferably only partly filled with liquid as this provides the most comfort for the user. It may be readily appreciated that if the cushion were entirely filled with liquid, it would be quite hard and would not have the desired bouyancy.

The pillow may be properly filled by holding it by one edge so that the liquid level can be observed and its position measured relative to the top edge and the bottom edge of the cushion. The outer compartment should be filled so that the water level is approximately one-third of the way from the bottom edge to the top edge of the cushion. A suitable position for the liquid level when the cushion is held vertically is indicated by the dashed line 27 in FIG. 1. The level in the inner compartment should be less than one-third of the way from the bottom edge to the top edge of the inner compartment. An appropriate level for the liquid in the inner compartment is also indicated in FIG. 1 by dashed line 29.

When the compartments 19 and 21 have been properly filled, the closures on the filler openings 25 and 23 are closed tightly and the cushion is inserted in the cover 12 and is ready for use. Of course, the cover 12 may be dispensed with if desired. The cover is desirable, however, as it is generally more comfortable to sit on a textile fabric material than on a vinyl or other impervious plastic material.

From the foregoing description and explanation it will be seen that a liquid filled cushion is provided having a shape and resiliancy exceptionally well adapted to provide sitting comfort to the user. The liquid fill in addition to providing desirable bouyant properties for the cushion, permits the cushion to be shipped and sold in a very light and compact form. In addition to the variations and modifications to the cushion which have been described or suggested, other modifications and variations will be apparent to those skilled in the art, and accordingly the scope of the invention is not to be deemed limited to the particular variations or modifications shown or suggested but is rather to be determined by reference to the appended claims.

What is claimed is:

1. A covered cushion having at least two compartments containing a liquid comprising two pieces of flexible plastic sheet material of substantially the same shape, said pieces being sealed together around their periphery to form a liquid-tight compartment and further having a joining seal in the form of a closed path in the central portion thereof dividing said compartment into two isolated portions, the first portion being centrally located in said cushion and the second portion completely surrounding the first portion, a filler port with a closure therefor in one of said pieces of sheet material placed to give access to the said first portion of said compartment, another filler port with a closure therefor in one of said pieces of sheet material placed to give access to the said second portion of said compartment.

2. A cushion as claimed in claim 1 wherein the said second portion of said liquid-tight compartment defined by said seal in the form of a closed path has a transverse dimension of approximately one-half the overall transverse dimension of said cushion.

3. A cushion as claimed in claim 1 wherein said plastic sheet is a polyvinyl chloride plastic sheet.

4. A cushion as claimed in claim 1 wherein said pieces of plastic sheet material are substantially square in shape.

5. A cushion as claimed in claim 1 wherein the thickness of said flexible plastic sheet is from 0.01 to 0.03 inches.

6. A cushion as claimed in claim 1 further including a textile fabric cover enclosing and covering said two pieces of flexible plastic sheet material.

7. A cushion having at least two compartments for containing a liquid comprising two pieces of flexible plastic sheet material of substantially the same shape, said pieces being sealed together around their periphery to form a liquid-tight compartment and further having a joining seal in the form of a closed path in the central portion thereof dividing said compartment into two isolated portions, the first portion being centrally located in said cushion and the second portion completely surrounding the first portion, a quantity of liquid having a volume of from one-tenth to one-half the maximum volume of said first portion of said compartment in said first portion, and a quantity of liquid having a volume of from one-tenth to one-half the maximum volume of said second portion of said compartment in said second portion.

8. A cushion as claimed in claim 7 wherein the said second portion of said liquid-tight compartment defined by said seal in the form of a closed path has a transverse dimension of approximately one-half the overall transverse dimension of said cushion.

9. A cushion as claimed in claim 7 wherein said plastic sheet is a polyvinyl chloride plastic sheet.

10. A cushion as claimed in claim 7 wherein said pieces of plastic sheet material are substantially square in shape.

11. A cushion as claimed in claim 7 wherein the thickness of said flexible plastic sheet is from 0.01 to 0.03 inches.

12. A cushion as claimed in claim 7 further including a textile fabric cover enclosing and covering said two pieces of flexible plastic sheet material.

13. A covered cushion having at least two compartments for containing a liquid comprising two pieces of flexible polyvinyl chloride plastic sheet material of substantially the same shape, each having a thickness of from 0.01 to 0.03 inches, said pieces being sealed together around their periphery to form a liquid-tight compartment and further having a joining seal in the form of a closed path in the central portion thereof dividing said compartment into two isolated portions, the first portion being centrally located in said cushion and the second portion completely surrounding the first portion, a filler port with a closure therefor in one of said pieces of sheet material placed to give access to the said first portion of said compartment, another filler port with a closure therefor in one of said pieces of sheet material placed to give access to the said second portion of said compartment.

14. A cushion as claimed in claim 13 wherein said pieces of plastic sheet material are substantially square in shape.

15. Apparatus as claimed in claim 14 further including the textile fabric cover enclosing and covering said two pieces of flexible plastic sheet material.

* * * * *